United States Patent [19]

Ogura et al.

[11] Patent Number: 4,940,408

[45] Date of Patent: Jul. 10, 1990

[54] TUNNEL KILN

[75] Inventors: Koji Ogura, Chiryu; Kazuhiro Miyahara, Nagoya, both of Japan

[73] Assignee: NGK Insulators, Ltd., Japan

[21] Appl. No.: 352,243

[22] Filed: May 16, 1989

[30] Foreign Application Priority Data

May 30, 1988 [JP] Japan ..... 63-70421[U]

[51] Int. Cl.[5] ..... F27B 9/26

[52] U.S. Cl. ..... 432/137; 432/241

[58] Field of Search ..... 432/133–137, 432/141, 241, 242

[56] References Cited

U.S. PATENT DOCUMENTS

| | | | |
|---|---|---|---|
| 2,003,450 | 6/1938 | Ladd | 432/241 |
| 2,502,828 | 4/1950 | Cooper et al. | 432/241 |
| 4,348,175 | 9/1982 | Molina | 432/241 |
| 4,504,221 | 3/1985 | Hartmann | 432/241 |
| 4,578,031 | 3/1986 | Johnson et al. | 432/241 |

*Primary Examiner*—Henry C. Yuen

*Attorney, Agent, or Firm*—Arnold, White & Durkee

[57] ABSTRACT

A tunnel kiln for firing molded ceramic green products includes a gate for feeding a kiln car into and out of the kiln. The gate located at low temperature parts of the kiln includes side walls made of a stainless steel having inclined surfaces and a ceiling made of a stainless steel and having inclined surfaces toward the side walls. The tunnel kiln further includes sand seals at connections between the side walls and the ceiling and receiving bases provided under lower ends of the side walls for receiving pyrolytically decomposed products. The side walls are formed with exhaust ports communicating with the receiving bases so that the pyrolytically decomposed products flow along the inclined surfaces of the ceiling and the side walls are once collected in the receiving bases and exhausted through the exhaust ports of the side walls to the outside of the kiln. With this arrangement, defective ceramic products due to decomposed products attached thereto are completely eliminated.

6 Claims, 2 Drawing Sheets

TUNNEL KILN

BACKGROUND OF THE INVENTION

This invention relates to a tunnel kiln, more particularly to a construction of a tunnel kiln having a gate for kiln cars of which temperature is relatively low.

The term "gate" used herein means an inlet and/or an outlet for feeding a kiln car into or out of a tunnel kiln.

With hitherto used tunnel kilns to be used for example for firing molded ceramic green products, gates for kiln cars are positioned at relatively low temperatures (0°-200° C.). Therefore, in addition of usual kiln materials, gates of the kilns have been made of steel plate kiln materials of a unitary construction having a rectangular cross-section for example made to a carbon steel or a stainless steel.

In general, molded ceramic green products to be fired include molding aids added thereto, such as methyl cellulose, carboxymethyl cellulose, polyvinyl alcohol, starch paste and the like as binders and surface active agents, and waxes and the like as lubricants. These molding aids are decomposed at relatively low temperatures so that atmosphere gases in kilns usually include these molding aids as pyrolytically decomposed gases.

With the conventional kilns or kilns made of steel plate kiln materials, therefore, the pyrolytically decomposed gases in the atmosphere gases tend to attach to ceilings of the kilns so that the attached decomposed gases drop onto the ceramic products resulting in defective products. On the other hand, it is difficult to exhaust the pyrolytically decomposed distillate.

SUMMARY OF THE INVENTION

It is an object of the invention to provide an improved tunnel kiln which eliminates all the disadvantages of the prior art and which is able to prevent faulty ceramic products due to decomposed gases and easy to recover distillates such as decomposed gases of molding aids.

In order to achieve the object, in a tunnel kiln for firing molded ceramic green products having a gate for kiln cars, the gate according to the invention comprises side walls made of a steel formed with exhaust ports passing therethrough, a ceiling made of a steel inclined downwardly toward the side walls, sand seals between the side walls, and a kiln car and receiving bases provided at lower end of the side walls for receiving decomposed products and communicating through the exhaust ports of the side walls with an outside of the kiln.

In a preferred embodiment of the invention, pipings are provided for supplying hot air to sand seals. In another embodiment, sand seals are provided at connections between the ceiling and side walls. In a further embodiment, sealing portions are provided at ends of the kiln body, such that sealing materials are interposed between the sealing portions and ends of adjacent kilns to be connected in series.

With the construction of the kiln according to the invention, pyrolytically decomposed products flow along the inclinations of the ceiling and the side walls to the lower ends of the side walls and once collected in the receiving bases provided under the lower ends of the side walls. The decomposed products are then exhausted through the exhaust ports of the side walls to the exterior so that defective products due to decomposed products attached thereto are eliminated.

In the preferred embodiment, hot air is supplied to sand seals at the lower portion of a kiln car to prevent the pyrolytically decomposed products from condensing at the lower portion of the kiln car. Moreover, sealing portions are provided at ends of the kiln body, so that elongation of steel plates due to thermal expansion can be taken up by movement of the sealing portions. Furthermore, sand seals are provided at connections between the ceiling and side walls to ensure a complete sealing therebetween.

Moreover, the ceiling and side walls are constructed by heat-resistant steels such as stainless steels according to the invention so that they are devoid of water absorption and have smooth surfaces which are corrosion resistant, with the result that the decomposed products easily flow thereon and cleaning of the kiln can be easily effected.

The invention will be more fully understood by referring to the following detailed specification and claims taken in connection with the appended drawings.

Detailed Explanation of Preferred Embodiments

Figure 1A:
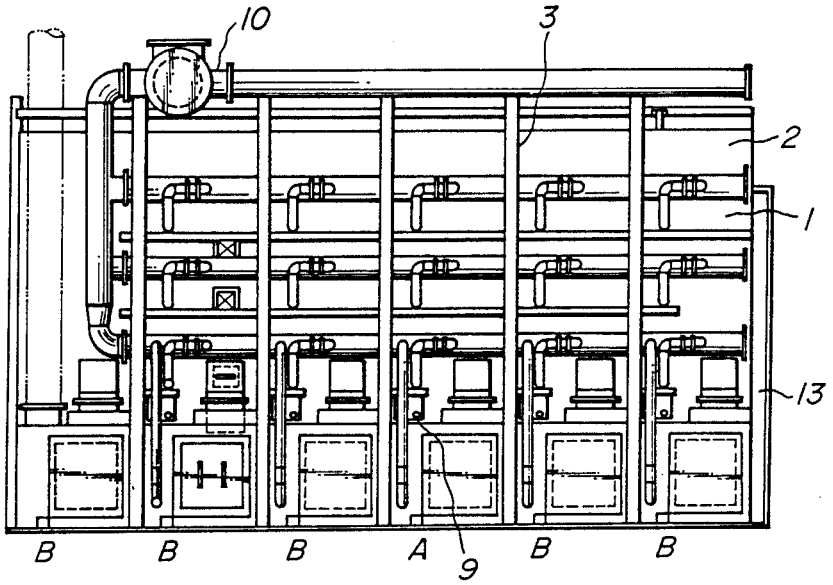
FIGS. 1*a* and 1*b* are a front and a side view illustrating one example of a kiln having a gate for kiln cars according to the invention.
Figure 1B:
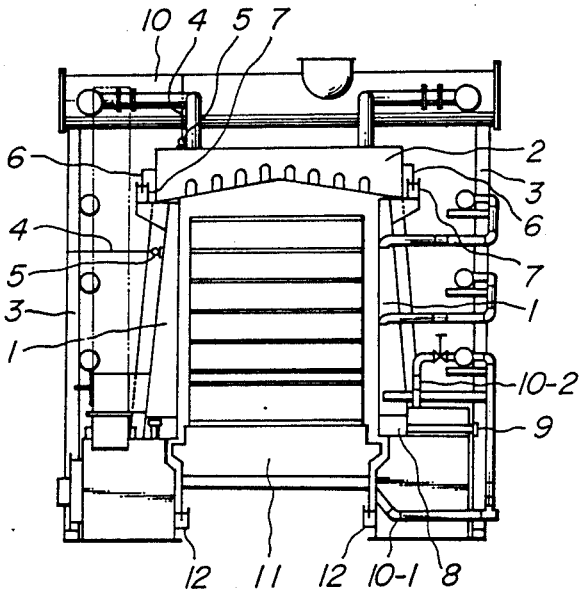
Figure 2:
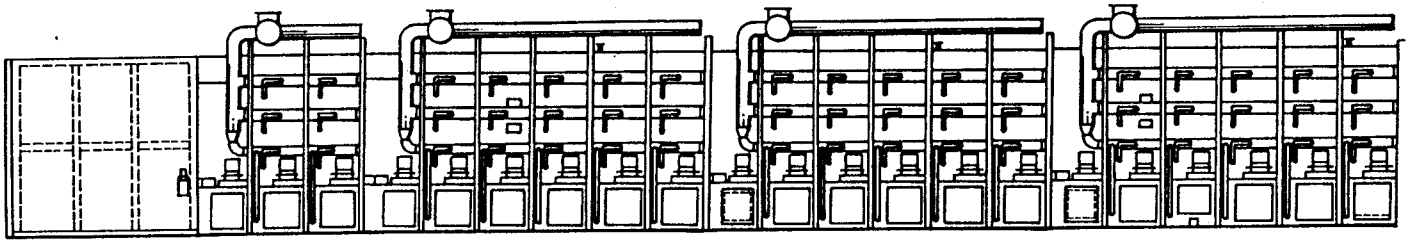
FIG. 2 is a front elevation illustrating the gate of the kiln according to the invention.

FIGS. 1*a* and 1*b* are a front and a side view illustrating one example of a construction of a tunnel kiln having a gate for kiln cars according to the invention. In this embodiment, the kiln is constructed by side walls 1 and a ceiling 2 made of a stainless steel. The side walls 1 and the ceiling 2 are supported by a plurality of support members 4. Anchors 5 are provided on the side walls 1 by means of which one end of the support members 4 are pivotally connected to the side walls 1.

The side walls 1 and the ceiling 2 are formed in separate bodies. Sealing plates 6 of the ceiling 2 have lower edges which are arranged in sands of sand seals 7. The side walls 1 and ceiling 2 include inclined surfaces permitting pyrolytically decomposed products to flow downwardly by gravity along these inclined surfaces. Receiving bases 8 are provided under the lower ends of the side walls 1 so that the decomposed products fallen along the side walls 1 are collected and exhausted out of the kiln through exhaust ports 9 communicating with the receiving bases and the exterior.

Moreover, pipings 10 are provided on outer frames 3 for supplying hot air to the kiln. Among these pipings, pipings 10–1 serve to supply the hot air to sand seals 12 of a kiln car 11 and pipings 10–2 to the receiving bases 8 for the pyrolytically decomposed products.

The support members 4, the anchors 5, pipings 10–1 and 10–2 and the like are plural (five, respectively in this embodiment shown in FIG. 1*a*) and extend in longitudinal directions spaced apart with constant distances. In installing the kiln body in position on a base, moreover, protrusions are provided with constant intervals on the base, while the side walls 1 are provided with an aperture at a location A adapted to be fitted with one of the protrusions and with elongated apertures at locations B adjustably receiving the protrusions of the base so that any elongations of the kiln body due to thermal expansions can be taken up by the adjustable fitting of the protrusions within the elongated apertures.

Figure 3:
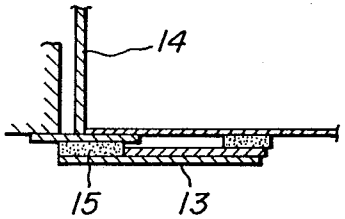
FIG. 3 is a sectional view illustrating a sealing portion of the kiln according to the invention.

Moreover, sealing portions are provided at ends of the side walls 1 and the ceiling 2 so as to take up thermal expansions in case of a plurality of kiln bodies connected in series. FIG. 3 illustrates one example of such a feature in which the sealing portion 13 is provided somewhat larger than an end 14 of an adjacent kiln body so that a sealing material is interposed between the sealing portion 13 and the end 14. With this arrangement, a complete sealing construction at a connection between the kiln bodies is accomplished and any elongation due to thermal expansion can be taken up.

The invention is not limited only to the embodiment above-described and other changes in form and details can be made without departing from the scope of the invention. For example, although the pipings, the support members and the like have been shown in five sets with constant intervals in the above embodiment, they may, of course, be provided in other numbers.

As can be seen from the above description, the tunnel kiln according to the invention can introduce pyrolytically decomposed products along the inclined surfaces of the ceiling and the side walls made of steel plates into the receiving bases provided under the lower ends of the side walls. The decomposed products once stored in the receiving bases are then exhausted through the exhaust openings to the exterior, thereby eliminating defective products due to attachment of the pyrolytically decomposed products.

According to the invention, moreover, the ceiling and side walls of the kiln are made of stainless steels so that corrosion-resistance is given to the kiln and cleaning of the kiln after used can be easily effected.

What is claimed is:

1. A tunnel kiln for firing molded ceramic green products having a gate for kiln cars, said gate comprising: steel side walls having exhaust ports passing therethrough; a steel ceiling disposed between the side walls and inclined downwardly toward the side walls; sand seals between the side walls and the kiln cars in said tunnel kiln; and receiving bases provided at a lower end of the side walls for receiving decomposed products, said receiving bases communicating with an outside of the kiln through said exhaust ports.

2. The tunnel kiln of claim 1, wherein the side walls comprise inclined surfaces to facilitate downward flow of the decomposed products.

3. The tunnel kiln of claim 1, wherein sand seals are provided at connections between the ceiling and the side walls.

4. The tunnel kiln of claim 1, wherein said sand seals between the side walls and the kiln cars are provided to seal lower ends of the kiln cars.

5. The tunnel kiln of claim 3, wherein pipings are provided for supplying hot air to at least some of said sand seals at connections between the ceiling and the side walls.

6. The tunnel kiln of claim 1, further comprising at least one sealing portion at ends of the side walls and the ceiling, wherein said sealing portion is larger than an end of an adjacent kiln such that a sealing material is interposed between said sealing portion and the end of the adjacent kiln.

* * * * *